United States Patent [19]

Larkin et al.

[11] 4,344,472

[45] Aug. 17, 1982

[54] PULL TAB TEAR CAP FOR CONTAINER PORT

[75] Inventors: Mark E. Larkin, Lindenhurst; Thomas W. Balistreri, Lake Bluff, both of Ill.

[73] Assignee: Abbott Laboratories, North Chicago, Ill.

[21] Appl. No.: 253,339

[22] Filed: Apr. 13, 1981

[51] Int. Cl.[3] ..... B65D 33/16

[52] U.S. Cl. ..... 150/8; 215/256

[58] Field of Search ..... 150/8; 215/247, 248, 215/249, 253, 254, 256

[56] References Cited

U.S. PATENT DOCUMENTS 3,915,212 10/1975 Bujan et al. ..... 150/8

4,187,893 2/1980 Bujan ..... 150/8

*Primary Examiner*—Donald F. Norton

*Attorney, Agent, or Firm*—Robert L. Niblack; Neil E. Hamilton

[57] ABSTRACT

A closure is provided for a container such as a flexible bag for I.V. liquids which is easily removed therefrom with a minimum amount of force. The easily-removable cap structure affords a sterile closure system, yet at the same time is susceptible of different geometric configurations which concentrate pulling forces in a confined area and in conjunction with a pre-weakened tear line so that a force not exceeding more than about 12 pounds will initiate a tearing away of the cap structure so as to expose the port and the contents of the container.

14 Claims, 11 Drawing Figures

PULL TAB TEAR CAP FOR CONTAINER PORT

BACKGROUND OF THE INVENTION

This invention relates to a tear open cap structure for a flexible container. More particularly, it relates to a tear-away cap structure of the pull-tab type for use in conjunction with containers for sterile solutions which will afford sterility of the contents of the container, yet will permit the opening of the container with a minimum amount of pulling force.

Closures and containers of the type concerned with in this invention are described in U.S. Pat. No. 3,915,212 as well as U.S. Pat. No. 4,187,893. The problem of removing caps or closures of the type described in these patents is that a pulling force is sometimes required which is greater than normally can be applied by a nurse of normal physical abilities. One given the task of constructing a closure system for a container with liquids to be given intravenously is that a sterile closure system must at all times be accomplished. In direct contrast, those utilizing the container are always concerned with being able to easily remove the caps which can be an important consideration during an emergency situation.

It is an advantage of the present invention to afford a cap structure for a container which will maintain the sterility of the contents of the container while at the same time be easily removed therefrom. Other advantages are a closure cap for a flexible container which is of the pull-tab tear type; a tear cap which will concentrate the pulling forces and direct them into a weaker area; a sterile closure which can be removed from an I.V. solution container and fabricated with existing molding equipment; a pull away tear cap which lends itself to various geometric configurations in fabrication; a tear-open closure for a flexible I.V. container which can be fabricated and applied to the container with existing equipment and in a fast and economical manner.

SUMMARY OF THE INVENTION

The foregoing advantages are accomplished and the shortcomings of the prior art are overcome by the present easily tear open closure which can seal the port structure of a container and includes a base portion having a skirt member for securing to the port structure. A weakened tear path is disposed in the base portion to afford complete removal thereof. A pull member extends away from the base portion and a force directing means is provided between the pull member and the base portion in the junction therebetween to direct a pulling force into the tear path. The removal section in the base portion is flexible so that the section can be pulled away from the base portion prior to the tearing away therefrom. The tear open closure can be removed with a pulling force of substantially not more than 12 pounds. While the pull member is susceptible of various geometric configurations, it is preferably formed with either a singular flat tab extending angularly from the base portion or centrally therefrom having three radiating rib members.

DESCRIPTION OF THE DRAWINGS

A better understanding of the present tear open closure for a container will be accomplished by reference to the drawings, wherein.

DESCRIPTION OF ONE EMBODIMENT

Figure 2:
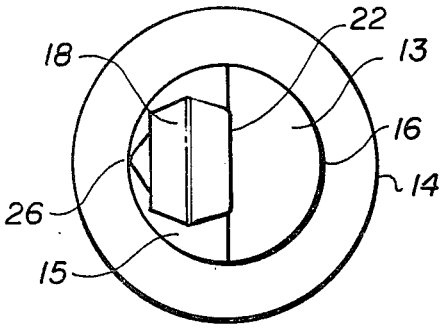
FIG. 2 is a top view taken along line 2—2 of FIG. 1.
Figure 4:
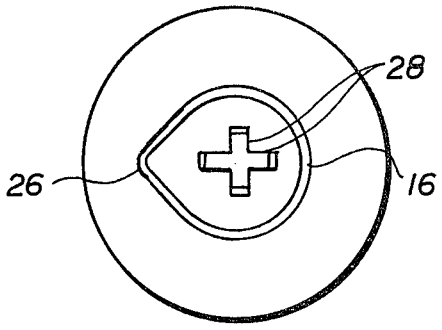
FIG. 4 is a bottom view taken along line 4—4 of FIG. 3.
Figure 1:
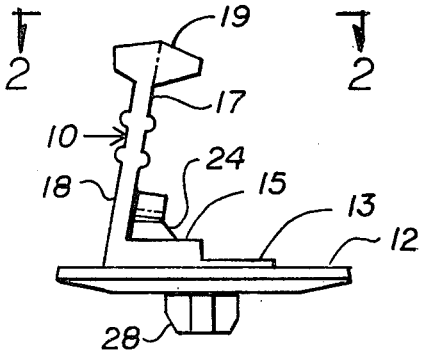
FIG. 1 is a view in side elevation showing one embodiment of the cap structure of this invention.
Figure 3:
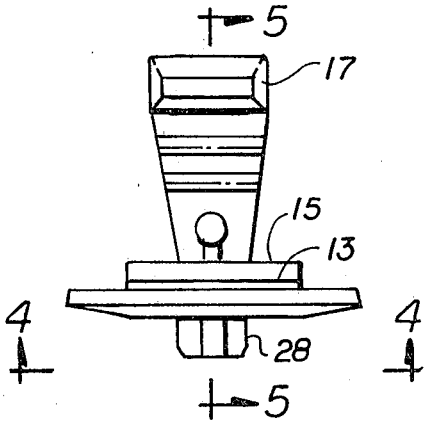
FIG. 3 is a back view in elevation of the cap shown in FIG. 1.
Figure 5:
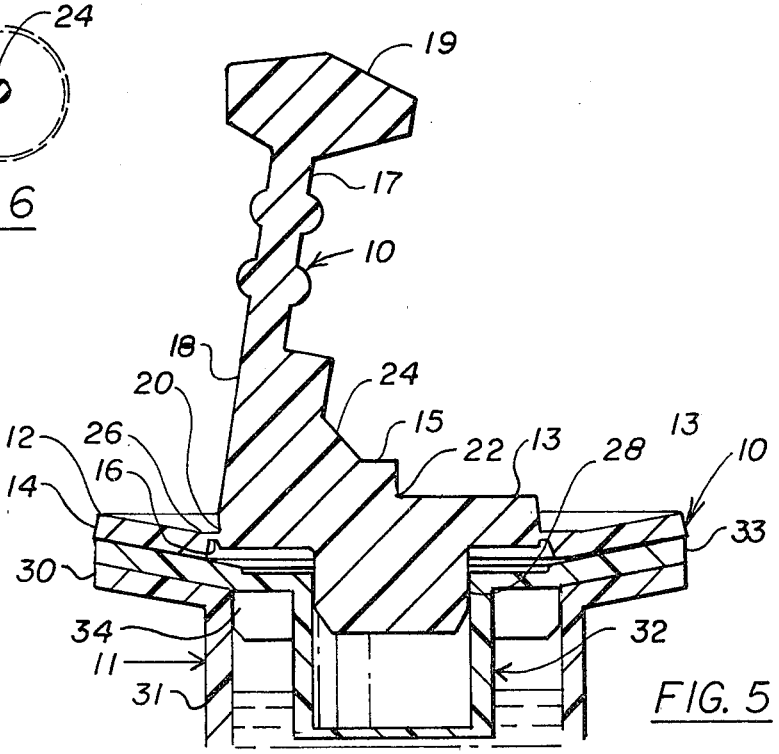
FIG. 5 is a view in vertical section taken along line 5—5 of FIG. 4, but including a container port.
Figure 7:
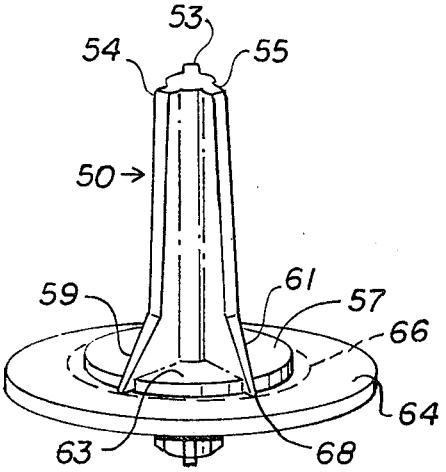
FIG. 7 is a perspective view of an alternative embodiment of a closure cap illustrating the present invention.
Figure 8:
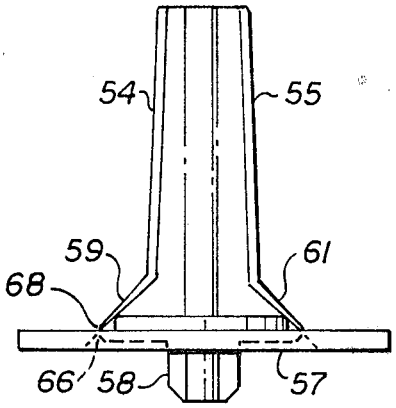
FIG. 8 is a view in side elevation of the closure cap shown in FIG. 7.
Figure 9:
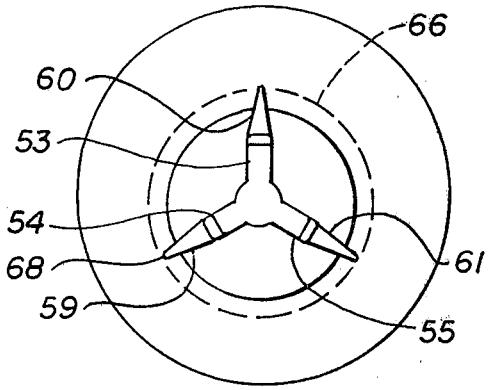
FIG. 9 is a top view of the closure cap shown in FIG. 8.

Proceeding to a detailed description of the present invention, the closure generally 10 includes a base portion 12 from which extends a tabular-like pull member 17. Also extending from base 12 is a first inner raised section 13 to which handle 17 is integrally molded and a second inner raised portion 15 which is also molded to the handle as well as the inner raised portion 13. A support rib 24 interconnects the pull member 17 and the second inner raised section 15. Extending oppositely from base portion 12 are the usual locating ribs 28 which are employed for positioning with minimal contact the closure in a port structure generally 11. As best seen in FIGS. 1 and 2, it would be noted that arm 18 of pull member 17 joins the base portion 12 at a slight angle and at a point as indicated at 26. This tear point is positioned in the path of weakened tear path 16 as will be best seen in FIGS. 2 and 4. Referring specifically to FIG. 5, closure 10 is shown sealed to port structure 11. This is effected by sealing skirt member 14 of closure 10 to annular flange 33 of inner tubular member 32 which in turn is sealed to port flange 30 of outer tubular member 31. In the usual manner, locating ribs 28 will position closure 10 in and over port structure 32 with minimal contact being being made by locating ribs 28 in inner tubular member 32.

Another embodiment is shown at 50 wherein a multiplicity of rib members 53, 54 and 55 extend upwardly and centrally from a base portion 57. The base 57 is circumscribed by a weakened tear path 66 with projections 59, 60 and 61 extending between the rib members and the tear path. It will be seen that each of the projections terminate in a force directing point 68 immediately above weakened tear path 66. Similar to the embodiment shown at 10, locating ribs 58 extend in a direction opposite rib members 53, 54 and 55 for positioning closure 50 in a port structure 51. Port structure 51 has a tubular member 71 for communication with the contents of the container and a port flange 72 for sealing with skirt member 64 forming the outer portion of base portion 57.

OPERATION

A better understanding of the advantages of closures 10 and 50 will be had by a description of their fabrication and operation. Both cap structures will be molded from a polyvinylchloride thermoplastic material and will be sealed by means of their respective skirt members 14 and 64 to port flanges 30 and 72 by R.F. weld sealing. It will be appreciated that port structures 11 and 51 will form a portion of and be attached to a typical flexible I.V. container such as described in U.S. Pat. No. 3,915,212.

Figure 6:
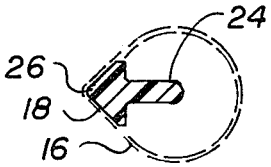
FIG. 6 is a partial view in horizontal section illustrating the concentration of pulling forces in the closure structure shown in FIGS. 1-5.

When it is desired to remove closure member 10 from port structure 11, pull member 17 will be grasped, such as by means of the thumb and forefinger and a pulling action exerted upwardly and in a slight clockwise manner as the cap is viewed in FIGS. 1 and 5. This pulling will be aided by enlarged head 19. During this pulling action, an upward flexing of the base portion 12 will be effected which will be along a line indicated by the numeral 22 and immediately between the second inner section 15 and the first inner raised section 13 of base portion 12. This line of force will be in a somewhat diametric direction as viewed in FIG. 2 and indicated by numeral 22. This slight upward pulling of the base portion will, in conjunction with the angled corner 20 as arm 18 extends from base portion 12, effect a concentration of forces at point 26 so that an initial tearing will be accomplished and with a pulling force of less than 12 pounds. This concentration of forces will be further appreciated by referring to the partial view in FIG. 6 wherein the support rib 24 and the arm 18 are shown in cross section. The pulling force to initiate tear is represented by the equation:

$$P=FA$$

P represents pulling force;

F equals the amount of force applied;

A equals effective area wherein the force is applied. If it is assumed that the width of arm 18 is 0.19 inch and the width of support rib 24 is 0.03 inch, then the approximate area of distributed force would be 0.010 square inches. Applying the above formula, and assuming a force of 400 pounds per square inch to initiate tear, the above formula would be applied as follows:

$$P=400\times0.010$$

$$P=4 \text{ lb (to start tear)}$$

Once the tear is initiated, then it will follow in opposing directions around the weakened tear path 16 until both the inner sections 13 and 15 will be removed.

Figure 11:
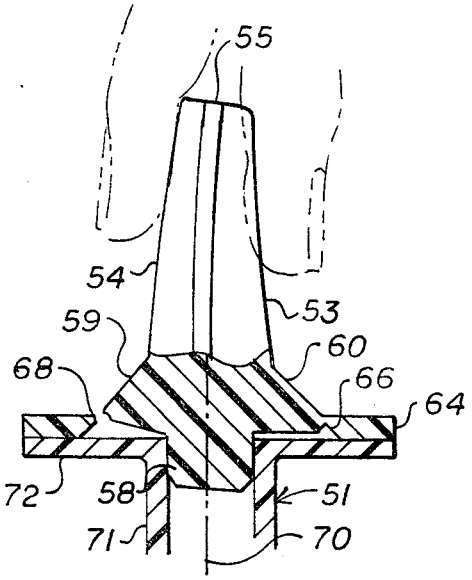
FIG. 11 is a view in side elevation and partially in vertical section illustrating the tearing away of the closure cap of FIG. 7 from a port structure.
Figure 10:
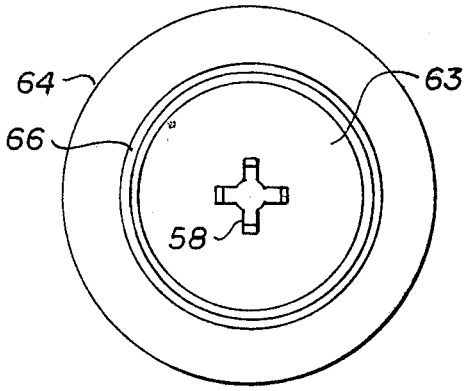
FIG. 10 is a bottom view of the closure cap shown in FIG. 7.

The same mechanical advantage of tear can be obtained in unit 50. In this particular unit, there is an advantage in that the forces can be directed along any one of three ribs 53, 54 and 55 and their associated projections 59, 60 and 61. The same initial flexing will be afforded, such as along line 70 which in conjunction with rib such as 54 and and projection such as 59, and will focus the force at point 68 to afford an initial tear at this stage. This is best seen in FIG. 11 and the tear will then follow in the same described clockwise and counterclockwise path along weakened tear path 66 to afford a complete removal of the inner portion 63.

In the previously described removal of cap 10, certain preferred dimensions and configurations have been determined. For example, a somewhat sharp corner 20 will be effected if arm 18 meets base portion 12 in a almost perpendicular manner while the radius of curvature of arm 18 as it angles upwardly from the base should be about 0.015 inch. Other preferred dimensions which have been found to effect efficient and low force tearing away are a base portion with a diameter of approximately 1 inch with a tear path having a diameter of 0.636 inch. As best seen in FIG. 2, the initial tear point 26 is curved in conjunction with the second inner section 15. A radius of curvature of 0.108 has been found to work effectively. Further, the weakened tear path has been found to be effective when the groove has an included angle of 60°. However, this can vary and be as low as 45° and as high as 90°.

In the foregoing embodiments, the cap structures including their tear away base portions have been indicated as being molded from a polyvinylchloride plastic material. The type of plastic materials are not critical and any thermoplastic material which can be effectively sealed to a bag port structure can be utilized so long as it will effect the initial tear feature. Additional thermoplastic material such as polypropylene or polyethylene could thus be utilized with heat or sonic sealing.

It will thus be seen that through the present invention there is now provided a cap structure for an I.V. solution container which is easily removed therefrom with a minimum amount of force. The cap structure can be fabricated from existing materials and existing equipment so that it can be applied in highly automated equipment. In this instance, it should be pointed out that the embodiment shown at 50 has advantages over that shown in 10 for the following reasons:

1. It can use a straight pull mold action during molding;
2. It will not distort during shipment as the ribs are intricately connected; and
3. Because of its compact nature, it is easier to handle concerning automatic feeding processes.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

We claim:

1. An easily tear open closure for sealing the port structure of a container comprising:

a base portion defining a skirt member for securing to said port structure;

means defining a weakened tear path to provide removal of a section of said base portion;

a pull member extending away from said base portion;

a force directing means constructed and arranged between said pull member and said base portion at the junction therebetween to direct a pulling force into said tear path;

said removal section in said base portion being flexible so that said section can be pulled away from said base portion prior to a tearing away therefrom;

whereby a pulling force of substantially not more than 12 pounds will concentrate said force at said junction to initiate the tearing away of said removal section.

2. The tear open closure as defined in claim 1 wherein said pull member includes at least one rib member extending outwardly from said base portion.

3. The tear open closure as defined in claim 2 wherein said pull member includes three said rib members extending from said base portion as well as from a central post member, said rib member spaced equidistantly from each other.

4. The tear open closure as defined in claim 2 or 3 wherein said tear path is substantially circular in configuration and said pull member is positioned within the confines thereof.

5. The tear open closure as defined in claim 2 wherein said pull member is further defined by a substantially flat tabular portion having a major portion extending in a direction substantially transverse to said rib member.

6. The tear open closure as defined in claim 1 wherein said pull member extends from said base portion a distance to be easily grasped by the thumb and forefinger of the human hand.

7. The tear open closure as defined in claim 6 wherein said closure is composed of a flexible thermoplastic material.

8. An easily tear open port structure for a flexible medical liquid container comprising:

a container port defined by a tubular member and a transversely extending flange;

a base portion closing said port and defining a skirt member secured to said flange;

means defining a weakened tear path to provide removal of a section of said base portion;

a pull member extending away from said base portion;

a force directing means constructed and arranged between said pull member and said base portion at the junction therebetween to direct a pulling force into said tear path;

said removal section in said base portion being flexible so that said section can be pulled away from said base portion prior to a tearing away therefrom;

whereby a pulling force of substantially not more than 12 pounds will concentrate said force at said junction to initiate the tearing away of said removal section.

9. The easily tear open port structure for a flexible medical liquid container as defined in claim 8 wherein said base portion includes a positioning member extending from said base portion in a direction opposite said pull member and into said container port tubular member.

10. The easy tear open port structure for a flexible medical liquid container as defined in claim 8 wherein all of said components are formed from a flexible thermoplastic material.

11. The easy tear open port structure for a flexible medical liquid container as defined in claim 8 wherein said pull member includes at least one rib member extending outwardly from said base portion.

12. The easy tear open port structure for a flexible medical liquid container as defined in claim 11 wherein said pull member includes three said rib members extending from said base portion as well as from a central post member, said rib member spaced equidistantly from each other.

13. The easy tear open port structure for a flexible medical liquid container as defined in claims 11 or 12 wherein said tear path is substantially circular in configuration and said pull member is positioned within the confines thereof.

14. The easy tear open port structure for a flexible medical liquid container as defined in claim 11 wherein said pull member is further defined by a substantially flat tabular portion having a major portion extending in a direction substantially transverse to said rib member.

* * * * *